US009827476B2

(12) United States Patent
Giner Gil et al.

(10) Patent No.: US 9,827,476 B2
(45) Date of Patent: Nov. 28, 2017

(54) WHEELCHAIR ACCESSORY FOR PLAYING SOCCER

(71) Applicants: ORGANIZACION DE SERVICIOS ORTOPEDICOS TOTALES, S.L., Valencia (ES); Fernando Giner Gil, Valencia (ES)

(72) Inventors: Fernando Giner Gil, Valencia (ES); José Bernardo Noblejas Granero, Valencia (ES)

(73) Assignees: ORGANIZACION DE SERVICIOS ORTOPEDICOS TOTALES S.L., Valencia (ES); FERNANDO GINER GIL, Valencia (ES)

( * ) Notice: Subject to any disclaimer, the term of this patent is extended or adjusted under 35 U.S.C. 154(b) by 0 days.

(21) Appl. No.: 15/304,253

(22) PCT Filed: Apr. 17, 2014

(86) PCT No.: PCT/ES2014/070333
§ 371 (c)(1),
(2) Date: Oct. 14, 2016

(87) PCT Pub. No.: WO2015/158938
PCT Pub. Date: Oct. 22, 2015

(65) Prior Publication Data
US 2017/0036086 A1 Feb. 9, 2017

(51) Int. Cl.
*A63B 71/00* (2006.01)
*A63B 69/00* (2006.01)

(52) U.S. Cl.
CPC ..... *A63B 69/002* (2013.01); *A63B 71/00* (2013.01); *A63B 71/0009* (2013.01); *A63B 2071/0018* (2013.01)

(58) Field of Classification Search
CPC ... A63B 69/002; A63B 71/0009; A63B 71/00; A63B 2071/0018
See application file for complete search history.

(56) References Cited

U.S. PATENT DOCUMENTS 4,213,648 A * 7/1980 Steichen ..... A61G 5/10 280/645
4,753,449 A * 6/1988 Doucet ..... A63B 47/00 280/304.1

(Continued)

FOREIGN PATENT DOCUMENTS

DE 9006549 U1 8/1990
ES 2150874 A1 12/2000

(Continued)

*Primary Examiner* — Kevin Hurley
*Assistant Examiner* — Gabriela C Craciun
(74) *Attorney, Agent, or Firm* — Richard M. Goldberg

(57) ABSTRACT

An accessory for wheelchairs for playing football as a sport includes a pair of mutually independent mechanisms, symmetrical in respect of a central longitudinal plane, each of which includes an operating bar (3) and a mechanism made up of a hinged quadrangle, formed of an articulated linkage base which forms a fixed part joined to the body of the chair and which houses a pin (5) for the operating bar (3) to rotate; a propulsion body (9) for propelling and retaining a ball, hinged to the fixed part on a hinge pin (91); an operating lever (17) joined to the lower part of the operating bar (3), and able to turn with said bar; and an auxiliary part (18), hinged to the operating lever (17) on a hinging pin (93), and to the mechanism for propelling and retaining the ball on one hinging pin (92).

21 Claims, 3 Drawing Sheets

(56) References Cited

U.S. PATENT DOCUMENTS

| | | | | | |
|---|---|---|---|---|---|
| 5,040,813 | A * | 8/1991 | Cumbie | ..... | A61G 5/10 280/304.1 |
| 5,154,331 | A * | 10/1992 | Sanders | ..... | A61G 5/10 224/275 |
| 5,807,185 | A * | 9/1998 | Raubuck | ..... | A63B 65/12 124/1 |
| 2014/0062054 | A1 | 3/2014 | Schaaper | | |

FOREIGN PATENT DOCUMENTS

| | | | |
|---|---|---|---|
| ES | 2151865 | A1 | 1/2001 |
| WO | 00/38799 | A1 | 6/2000 |
| WO | 00/71069 | A1 | 11/2000 |

* cited by examiner

Fig. 3
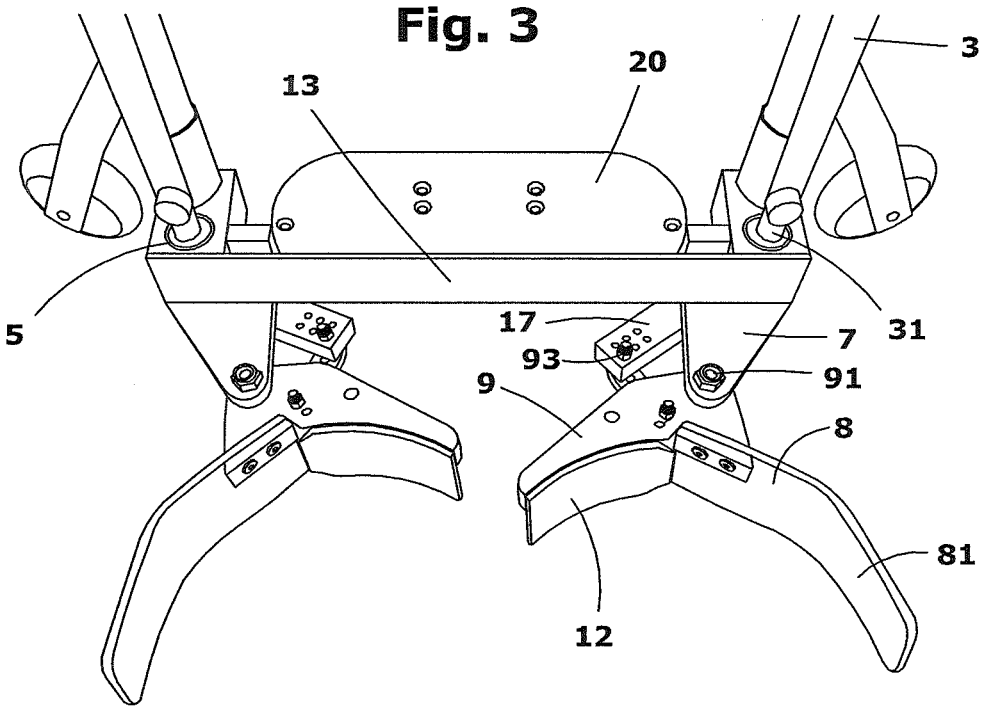
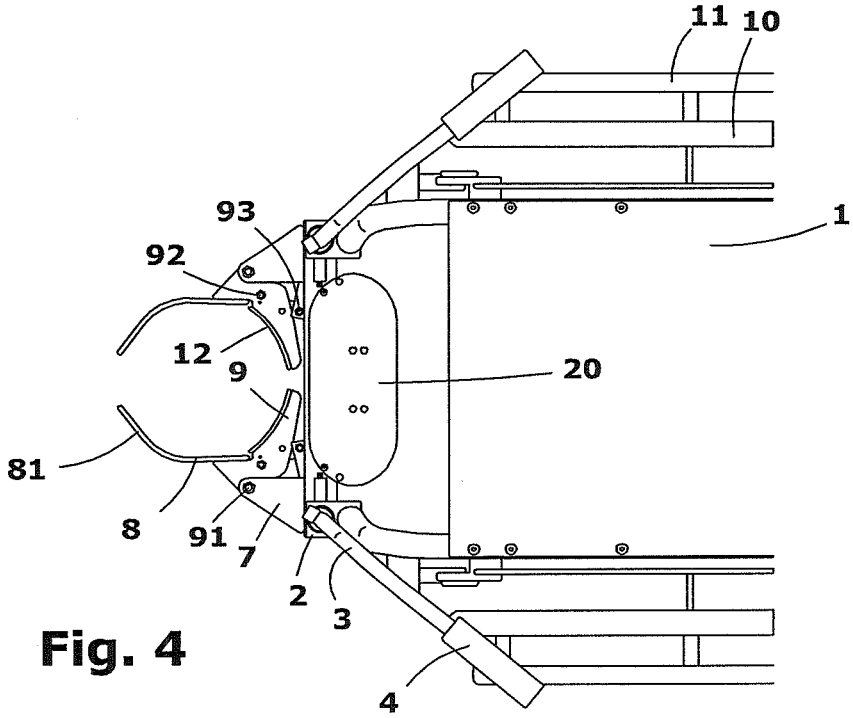
Fig. 4

WHEELCHAIR ACCESSORY FOR PLAYING SOCCER

BACKGROUND OF THE INVENTION

This invention consists of a device to be used as an accessory on wheelchairs for playing football, normally by people with reduced mobility in their legs. This accessory consists of a pair of manually-operated levers, one for each hand, which have devices at the bottom for retrieving and shooting a conventional ball.

Football is one of the most socially popular sports in the world today, and although it has a pre-eminent place in such geographical areas as Europe, Africa and Central and South America or Oceania, it is also very extensively disseminated in other areas such as North America or Asia.

The social integration of people with reduced mobility has meant that resources have been created for these people to practise sports which, generally involving some modifications in the relevant rules, not only allow practice of such sports, but also holding competitions. One example of this is basketball, in which an extremely stable and light "sports" wheelchair is moved by users at the same time as they move the ball and throw this into the basket in the conventional way.

The scope of sport for people with reduced mobility reaches its highest point at the Paralympics, or Olympic Games, which are held at the Olympic installations usually a few days after the end of the ordinary Olympic games, taking place every four years.

Since the injuries depriving people with reduced mobility from moving generally affect first of all the legs, however, there are sports which have not been within the possibilities of these people, as is the case of football.

STATE OF THE ART

U.S. Pat. No. 4,753,449 describes a wheelchair provided with an accessory for holding a ball, in which this device is made up of an annular body of a smaller diameter than that of the ball to be held. The holding ring is held to the chair on one of its sides by means of a securing arm which has a horizontal part bringing this ring to a convenient position to be handled by the user. Although this is one way to solve the matter of carrying a ball, for example, in practising basketball, this does not represent a solution in a sport such as football.

U.S. Pat. No. 5,040,813 describes a wheelchair similar to the previous one, in which this describes, as well as a support ring for a ball, other devices for practising different activities. Through being a solution similar to the previous ones, the drawbacks as regards solving the problem brought up are also the same as in the previous case.

WO 00/38799 describes a device for playing football in a wheelchair. It consists of a device in the shape of a foot provided with a manually-held handle used to push the football.

WO 00/71069 describes a frame with two lateral bars which are joined to form a raised loop allowing the non-confined housing of the ball, to be pushed by the movement of the wheelchair itself.

Finally, DE 9006549 U1 describes an electro-mechanical accessory for driving along a small ball, to be placed on the lower part of a wheelchair.

Although some of these devices allow some sports to be practised, they do not provide a practical and independent solution enabling retaining and propelling the ball for use in football in different directions, with the force determined by the user, which are mechanically simple and do not require any external power supply.

SUMMARY OF THE INVENTION

The invention now being put forward consists of an accessory for wheelchairs for playing football as a sport, comprising a pair of shafts provided at the top with two controlling handles forming an angle of roughly 90° with the corresponding shaft, and provided at the bottom with two housing half-bodies, with a rear portion and a front portion, each of which can take a closed position, in which the ball is trapped inside the housing formed by the half-bodies, and an open position, in which the ball is free. Turning the shaft fitted with the handle at the same time as propelling the ball opens the housing, enabling the ball to be ejected.

The propulsion from the shaft is carried out by a multiplier body. The ball can be driven in different directions depending on the extent to which the half-housings are open, the intensity of the opening force of each of these and/or the time lag in the opening time. The propulsion undergone by the ball will obviously depend on the speed at which the controlling handle-levers are moved. The ball can likewise be hit with the outer part of the propulsion elements.

One of the reasons for making a wheelchair for playing football is that there are many fans of this sport, including many people with spinal cord injuries or with some kind of degenerative disorder who could enjoy the subject of this invention. Another reason is to ensure many people's social integration, in such a way that competitive sport can bring them back to, or keep them in, a good frame of mind. The widespread dissemination of football as a sport has not however until now had a practical solution enabling people with reduced mobility to play this in a manner which, though not identical in its execution, is indeed the same in its basic conceptual aspects.

Different factors were taken into account in order to create the subject of this invention:

- The device was not to be motor-driven, as this increases the weight of the wheelchair very significantly, even more so when high powers are required on occasions, as well as the batteries needed for the electrical power supply;
- On a complementary level, the device had to have a moderate cost, to ensure that this could be affordable in respect of what a competition wheelchair costs;
- At the same time the weight had to be kept to the very minimum, so as not to impede the operation and movement of the chair;
- The device had to enable the ball to be propelled beyond the movement of the chair;
- The device also had to enable the ball to be directionally propelled by the user at their own wish;
- Apart from this, the device had to be integrated in the wheelchair as a whole, to ensure that this would remain firmly attached to this during movement.
- This had to be easily moveable.

All these requirements have been satisfactorily achieved in the invention being proposed.

BRIEF DESCRIPTION OF THE DRAWINGS

In order to illustrate the following explanation, three sheets of drawings are enclosed with this descriptive report, in which the essence of this invention is represented in six figures for illustration purposes without implying any limitation thereby, and in which the following items can be seen:

FIG. 3 shows a view from an upper frontal perspective of the device of the invention, in an open position;

FIG. 4 shows a view similar to that of FIG. 3, but from further away, with the device of the invention in its closed position;

DESCRIPTION OF THE PREFERENTIAL FORMS OF EMBODIMENT

Figure 1:
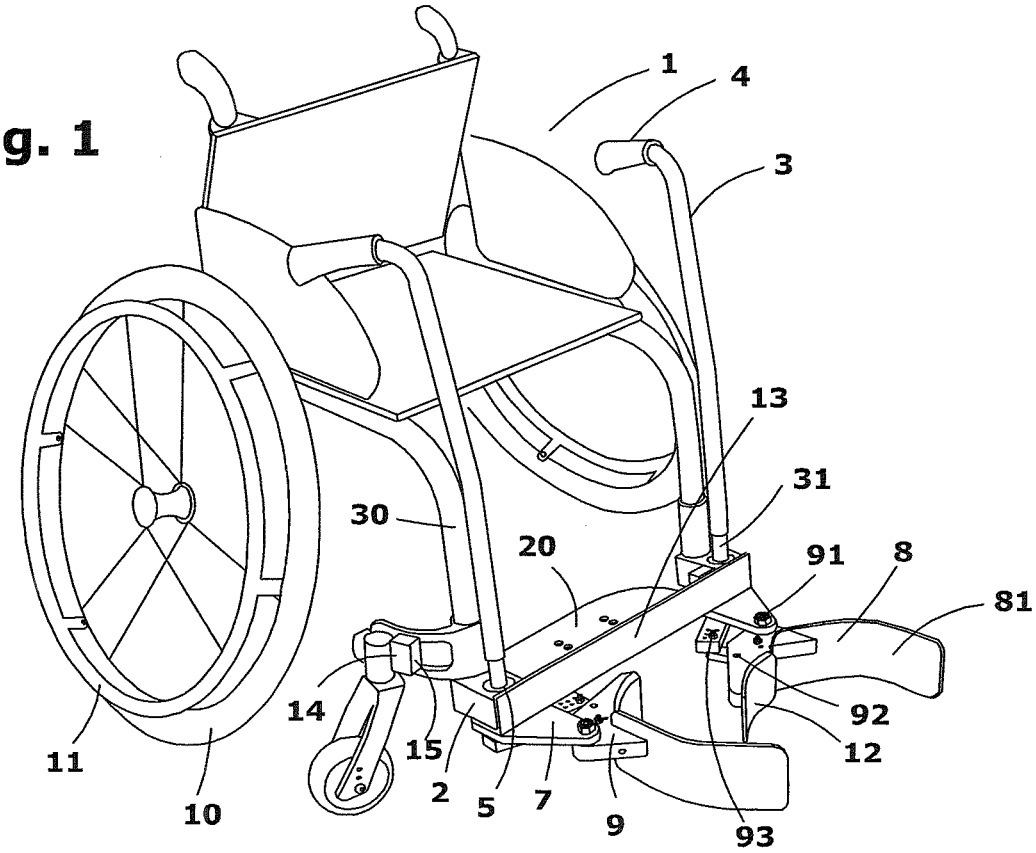
FIG. 1 shows a general view in perspective of a wheelchair provided with the accessory of the invention for playing football as a sport.
Figure 2:
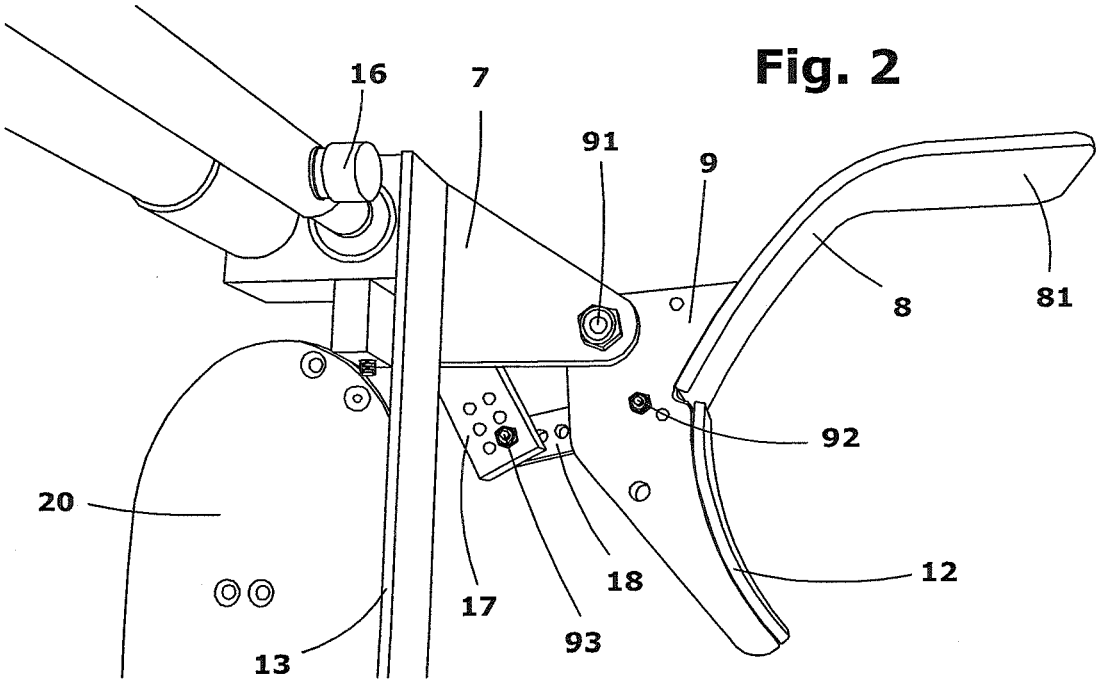
FIG. 2 shows a view of a detail of a propulsion mechanism of the device for retaining and shooting the ball in the accessory of the invention.
Figure 5:
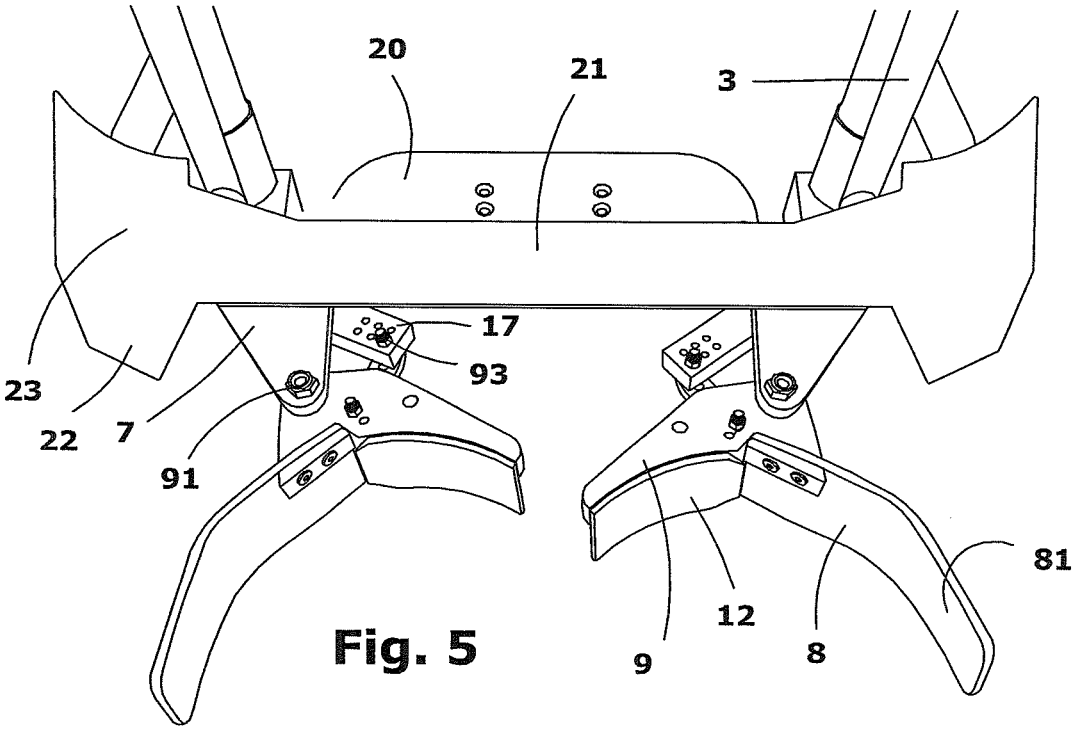
FIG. 5 shows a view from a fairly low front perspective of the device of the invention provided with a protection body.
Figure 6:
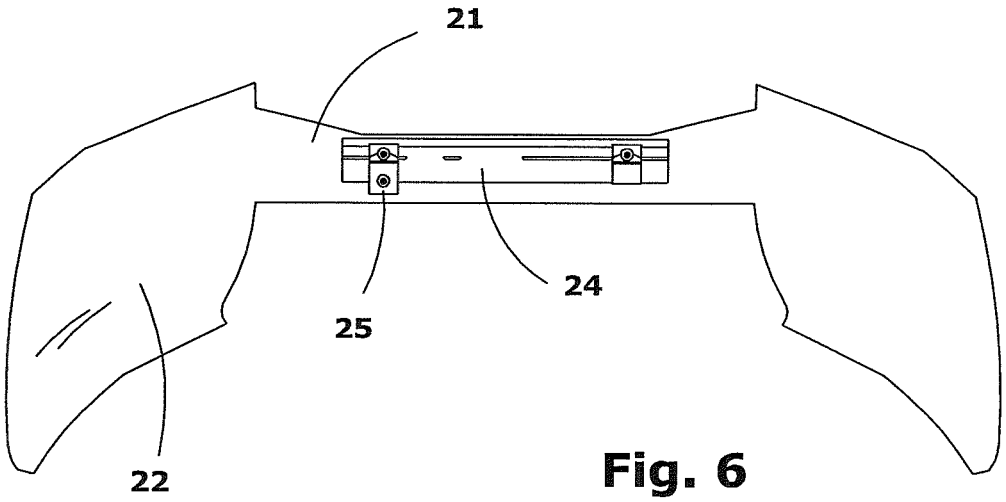
FIG. 6 shows a rear view of the protection body provided with securing means as an example.

An accessory for wheelchairs (1) for playing football is described, with the invention similarly extending to a wheelchair (1) provided with this accessory.

A wheelchair, of the sort used for practising different sports, is provided with large wheels (10) (with a diameter of roughly 60-70 cm) in turn provided with pulling or drive rings (11), of a slightly smaller diameter than that of the wheels, which are slightly separated from the former. The planes defined by the wheels (10) with each other are divergent towards the bottom, so as to increase stability as compared with conventional wheelchairs with vertical wheels.

The front part is also provided with a support structure which has small-sized wheels (31) (roughly 10 cm) at the bottom.

The front part is normally provided with a structure (30) for supporting a platform (20) acting as a support for the feet.

According to the invention, an accessory is described which is placed on the front part of the chair (1) beside the platform (20) or replacing this, which is provided with a pair of symmetrical mechanisms.

Each of these mechanisms is formed of an operating bar (3), provided with an operating handle (4), normally placed at the top of said operating bar (3). The operating bar is placed in an essentially vertical position. The operating handle (4) is preferably conjoint with the operating bar (3), and is formed by bending the upper end of said operating bar (3). The operating handle (4) is provided with a grip, generally as a covering of said handle. This is normally positioned at an angle of roughly 90° in respect of the operating bar.

In a zone close to its bottom, the operating bar (3) is hinged to an articulated linkage base (2), which constitutes a fixed piece conjoint with the body of the chair, and which forms a rotation pin (5) of the operating bar (3). The operating bar obviously has its axial displacement restricted in this housing, but its rotation is not limited.

According to a preferential option, the operating bar (3) is made up of more than one part, and can be dismantled in respect of at least a lower portion (31), so that after said bar and said lower portion have been assembled the bar is a continuous part. The securing system can for example be by means of screws or by means of a pressure screw.

There is also an operating lever (17), conjoint with the operating shaft (3), in the zone close to its bottom end, normally under the articulated linkage base (2), but possibly also at the top or in an intermediate zone or recess. This operating lever comprises at least one perforation which will form a hinging pin (93) of an auxiliary part (18), in turn provided with an hinging pin (92) at its opposite end.

According to a specific embodiment, the articulated linkage base has a frontal projection (7), provided with a hinging pin (91).

A propulsion body (9) is placed hinged to the auxiliary part (18) and to the frontal projection (7).

The propulsion body (9) is thus hinged to hinge pin (91) and to hinge pin (92); the auxiliary part is hinged to hinge pin (92) and to shaft (93), and the operating lever is hinged to pin (5) and to shaft (93), the articulated linkage base (with its frontal projection) constituting a fixed part provided with pins (5) and (91). This means that the propulsion body (9), the auxiliary part (18), the operating lever (17) and the articulated linkage base (2) form—with the frontal projection (7) (fixed body), the operating lever (17) and auxiliary part (18)—a tetragon or quadrangle hinged with a single degree of freedom determined by the position or movement of the operating lever.

The pair of symmetrical mechanisms is preferably provided with a connection plate (13), which has several effects, making the assembly for supporting the two mechanisms stiffer, protecting the user's feet from possible impacts of the ball, holding the platform (20) for supporting the feet, and establishing a position limit for the user's feet. The propulsion bodies (9), as was already seen, are articulated about a pin (5) on the fixed part which forms the frontal projection (7) of the articulated linkage base (2) and this is driven to provide the required force by the rotation of the operating bar (3), thanks to the auxiliary part (18).

According to a preferential option, the operating levers (17) are provided with a plurality of housings in which the hinging pin (93) can be located and the auxiliary parts (18) also have different housings for said shaft (common to both parts, in which they are hinged together) since the adjustment of the speed ratio between that of the rotation of the operating bar (3) and the corresponding propulsion body (9) will depend on the relative lengths and positions of the elements of the aforementioned articulated tetragon.

Each of the propulsion bodies (9) is made up of an interior portion (12) oriented towards the centre, and an exterior portion (8), which forms an enveloping curve; according to one form of preferential embodiment, the end of the outer portion (81) is slightly bent towards the centre.

Both the interior portion (12) and the exterior portion (8) are made up of a stiff plate with a vertical curved surface, which is preferably from 2 to 10 cm from the ground and from 5 to 25 cm in height. Insofar as a ball like the ones used in football has a circumference of 68-70 cm, its diameter is roughly 22 cm. The central part, where the maximum horizontal circumference of the ball is located, will thus be located at a height of roughly 11 cm. The interior (12) and exterior (8) portions will thus have to be located at said height, plus an appropriate range upwards and downwards, which can absorb any bounces undergone by the ball. The interior portion is the one that will receive the greatest number of impacts from the ball, and has to have a minimum flexibility so that the action of the operating handle (4) on the propulsion body (9) is as direct as possible, for which reason it has to be very strong. The exterior portion (8) may receive some impact, and can be used to hit the ball laterally from the outside or from the inside. This may be made of a lighter, possibly transparent, material, such as plastic, which enables the ball to be seen from an outside position. Both portions may nevertheless be made of metal or plastic materials.

The accessory of the invention is designed to include a protection shield (21), with a cutaway central zone under which the mechanism for propelling and retaining the ball emerges, with lateral portions (22), where there is a space (23) on which information or advertising messages can be inserted.

According to one embodiment, said protection shield (21) is held to the connection plate (13) by means of fork-clamps (25), held on an anchor plate (24). The chair furthermore comprises a support (14) with a means of adherence, such as for example a means of textile attachment, a magnetic system or clips, and the protection shield consists of the part complementary to said means of adherence.

What is claimed is:

1. An accessory for wheelchairs for playing football, comprising:

a pair of mutually independent mechanisms, symmetrical in respect of a central longitudinal plane, each of which comprises:

an operating bar; and a mechanism made up of an articulated quadrangle, formed of:

an articulated linkage base which forms a fixed part joined to a body of a wheelchair and which houses a pin for rotation of the operating bar;

a propulsion body for propelling and retaining a ball, hinged to the fixed part on one hinge pin;

an operating lever joined to a lower part of the operating bar, and adapted to turn with said bar; and an auxiliary part, hinged to the operating lever on a hinging pin, and to the propulsion body for propelling and retaining the ball on one hinging pin.

2. An accessory for wheelchairs for playing football, according to claim 1, wherein each of the operating bars is provided with an operating handle.

3. An accessory for wheelchairs for playing football, according to claim 2, wherein the operating handle is conjoint with the operating bar, and is formed by bending an upper end of said operating bar, and provided with a grip covering said handle, said operating handle being positioned at an angle of about 90° in respect of the operating bar.

4. An accessory for wheelchairs for playing football, according to claim 1, wherein the operating bar is made up of more than one part, and is adapted to be dismantled in respect of at least one lower portion, so that after said bar and said at least one lower portion have been assembled the bar constitutes a continuous part.

5. An accessory for wheelchairs for playing football, according to claim 1, wherein the operating lever comprises different housings for the hinging pin for hinging with the auxiliary part.

6. An accessory for wheelchairs for playing football, according to claim 1, wherein the auxiliary part has different housings for the hinging pin.

7. An accessory for wheelchairs for playing football, according to claim 1, wherein the pair of symmetrical mechanisms is provided with a connection plate therebetween stiffening a support assembly of the two mechanisms, protecting a user's feet from possible impacts from the ball, supporting the user's feet and limiting the position of those feet.

8. An accessory for wheelchairs for playing football, according to claim 1, wherein each of the propulsion bodies is formed of an interior portion oriented towards a center position and an exterior portion, which forms an enveloping curve.

9. An accessory for wheelchairs for playing football, according to claim 8, wherein an end of the exterior portion is slightly bent towards the center position.

10. An accessory for wheelchairs for playing football, according to claim 8, wherein the interior portion and the exterior portion are formed of a rigid plate with a vertical curved surface.

11. An accessory for wheelchairs for playing football, according to claim 8, wherein the interior and exterior portions are spaced from 2 to 10 cm away from ground.

12. An accessory for wheelchairs for playing football, according to claim 8, wherein the interior and exterior portions are from 5 to 25 cm high.

13. An accessory for wheelchairs for playing football, according to claim 8, wherein at least one of the interior portion and the exterior portion is made of a metal material.

14. An accessory for wheelchairs for playing football, according to claim 8, wherein at least one of the interior portion and the exterior portion is made of a plastic material.

15. An accessory for wheelchairs for playing football, according to claim 14, wherein the exterior portion is transparent.

16. An accessory for wheelchairs for playing football, according to claim 1, further comprising a protection shield.

17. An accessory for wheelchairs for playing football, according to claim 16, wherein the protection shield comprises a cutaway central zone under which the mechanism emerges and lateral portions, where there is a space for inserting at least one of information and advertising messages.

18. An accessory for wheelchairs for playing football, according to claim 16, wherein the protection shield comprises fork-clamps for securing to the protection shield to a connection plate between the pair of symmetrical mechanisms.

19. An accessory for wheelchairs for playing football according to claim 16, further comprising an arrangement for adhering the protection shield to the wheelchair, selected from the group consisting of a textile attachment arrangement, a magnetic system and clips, with a complementary part located in the wheelchair.

20. A wheelchair including the accessory of claim 1.

21. An accessory for wheelchairs for playing football, according to claim 1, wherein the articulated linkage base has a frontal projection, in which the hinge pin is placed.

* * * * *